United States Patent [19]

Langstedt

[11] Patent Number: 5,023,419

[45] Date of Patent: Jun. 11, 1991

[54] DEVICE FOR THE INDUCTION HEATING OF A WORKPIECE

[76] Inventor: Göran Langstedt, Nyhamnsgatan 1, S-263 32 Höganäs, Sweden

[21] Appl. No.: 435,383

[22] PCT Filed: May 5, 1988

[86] PCT No.: PCT/SE88/00237

§ 371 Date: Dec. 26, 1989

§ 102(e) Date: Dec. 26, 1989

[87] PCT Pub. No.: WO88/09106

PCT Pub. Date: Nov. 17, 1988

[30] Foreign Application Priority Data

May 7, 1987 [SE] Sweden ..... 8701888

[51] Int. Cl.[5] ..... H05B 6/10

[52] U.S. Cl. ..... 219/10.57; 219/10.75; 219/10.71; 219/10.79

[58] Field of Search ..... 219/10.57, 10.41, 10.43, 219/10.75, 10.67, 10.71, 10.79, 10.77, 10.491

[56] References Cited

U.S. PATENT DOCUMENTS

| | | | |
|---|---|---|---|
| 1,725,465 | 8/1929 | Manson | 219/10.79 |
| 3,187,155 | 6/1965 | Beckert et al. | 219/10.79 |
| 3,467,806 | 9/1969 | Dixon | 219/10.79 |
| 3,472,941 | 10/1969 | Floymayr | 219/10.75 |
| 4,311,896 | 1/1982 | Junya | 219/10.57 |
| 4,775,772 | 10/1988 | Chaboseau | 219/10.79 |
| 4,828,227 | 5/1989 | Georges et al. | 219/10.79 |

FOREIGN PATENT DOCUMENTS

| | | |
|---|---|---|
| 2322129 | 11/1973 | Fed. Rep. of Germany . |
| 2900655 | 1/1979 | Fed. Rep. of Germany . |
| 142116 | 9/1953 | Sweden . |
| 849560 | 7/1981 | U.S.S.R. . |
| 924920 | 4/1982 | U.S.S.R. . |

*Primary Examiner*—Philip H. Leung

*Attorney, Agent, or Firm*—Marshall & Melhorn

[57] ABSTRACT

A device for heating a workpiece includes a coil arrangement connected to a voltage source for generating a magnetic field. The coil arrangement is positioned around a core of electric steel sheeting having two poles spaced apart to form an air gap for accommodating a central portion of a workpiece. One of the poles is movable wherein the poles engage the workpiece which bridges the air gap or engage each other by extending through the center of an annular workpiece. The coil arrangement includes first and second coils, each positioned about one of the poles, generating a magnetic field inside and outside the core. The magnetic field concentrated in the core heats the central portion of the workpiece while outer magnetic field heats peripheral portions of the workpiece to achieve a rapid and uniform heating of the workpiece. At least one of the coils can be moved with respect to the associated pole to control the heating of the workpiece. A third coil can be positioned around the air gap and connected in series with the first and second coils.

8 Claims, 1 Drawing Sheet

DEVICE FOR THE INDUCTION HEATING OF A WORKPIECE

The present invention relates to methods and devices for magnetically heating a workpiece consisting at least partly of metal More specifically, the invention is concerned with the preheating of moulding or press tools, the separation of metal from a polymer, the production of composite materials, and the hardening of adhesive between two metal members.

For the preheating of press tools, which is necessary before the tool is operated, use is made at present of hot-air furnaces in which the tool is heated to about 450°. This takes about 10 hours, which is far too long for an efficient production. Furthermore, it is difficult in a furnace, to heat the press tool to a uniform temperature across the entire tool cross-section.

Hitherto, a number of techniques have been utilised to separate polymeric materials, such as rubber and plastic from metal. One technique involved burning-off of the polymer, which has caused emissions hazardous to the environment, and structural changes and stress in the metal. DE 2,900,655 indicates a different technique involving the use of an induction coil. An object, for example a vehicle tire, is positioned within the induction coil which is activated by a high-frequency voltage to generate a magnetic field heating the metal in the vehicle tire to such an extent that the polymer can be detached from the metal. Generating high-frequency voltage is expensive and cannot be utilised for all types of objects. If the object has projecting metal parts, a so-called point effect is obtained which means that the projecting metal part is heated to red heat. Furthermore, the high-frequency technique is restricted to relatively thin objects since the penetration depth in metal is slight when use is made of high frequency, for example 1 to 16 kHz.

A first object of the invention is to achieve rapid and uniform heating of a workpiece, without having to rely on the shape and thickness of the object for the desired result.

A second object of the invention is to provide an inexpensive and uncomplicated heating device adapted to utilise the existing electric mains.

A third object is to provide a device which, upon separation, gives clean and faultless final products, i.e. metal parts which are clean from polymeric material and which have not been affected by structural changes and stress, as well as polymeric material which is not heated to temperatures at which it is destroyed, the final products being reusable.

A fourth object of the invention is to provide an energy-saving heating method by which the losses are restricted to the heat developed in the coils, and to losses in the core.

These objects are achieved by devices and methods having the features defined in the characterising clauses of the appended claims.

Embodiments of the invention will be described in the more detail below, reference being had to the accompanying drawings.

FIG. 3 shows a third embodiment adapted to separate polymeric material from a metal container or the like.

Figure 1:
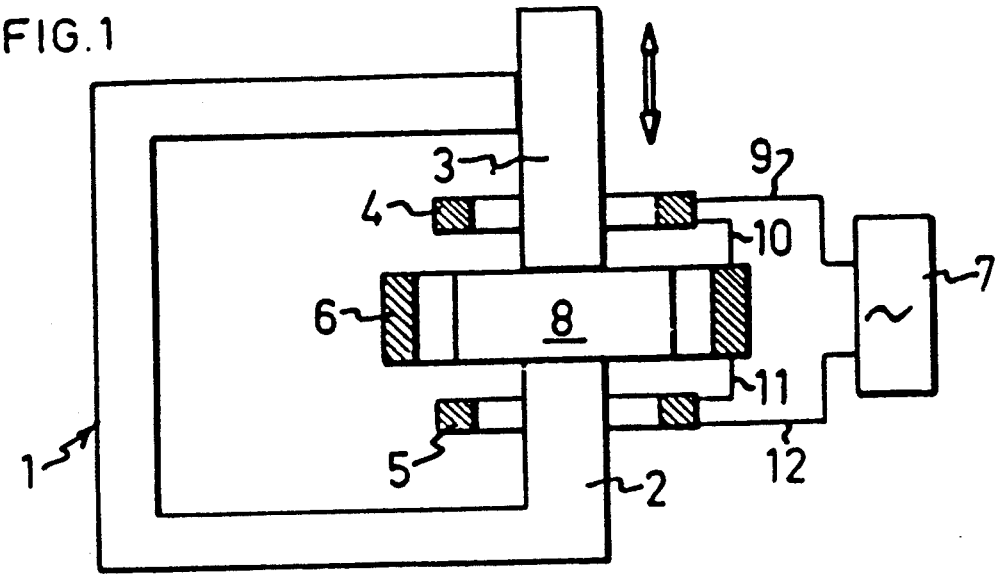
FIG. 1 shows a first embodiment of the invention, in which a movable core pole is displaced upwardly to produce an air gap adapted to accommodate a workpiece.

FIG. 1 illustrates a core 1 of transformer sheet steel. The core has a stationary pole 2 and a movable pole 3. The pole 3 is movable into engagement with the pole 2 to form a short-circuited core. In the embodiment shown in FIG. 1, the movable pole 3 is displaced upwardly to form an air gap between itself and the stationary core 2. A first coil 4 is positioned around the movable pole and a second coil 5 is positioned around the stationary pole. A third coil 6 is positioned around the air gap between the first and the second coil. The coils 4, 5 and 6 are connected in series via lines 9, 10, 11 and 12 and connected to an alternating voltage source 7 which is a single-phase source utilizing the zero conductor of the electric mains and gives, for example, 220 V at 50 Hz. Naturally, also two or three phases may be utilised. In one of its aspects, the invention aims at providing adequate heating by means of the normal mains voltage and frequency.

The poles 2 and 3 have been designed to retain the workpiece during heating, and therefore there is no need of special means for holding the workpiece during heating The workpiece consists of metal coated with a polymeric material, such as rubber. The workpiece may also be a press or moulding tool. In FIG. 1, the workpiece extends beyond the core, but also smaller workpieces of a width below the cross-sectional area of the core can be heated in a device according to the invention. One example of such a workpiece is a ball bearing. The workpiece may have at least one metal portion bridging the air gap and short-circuiting the core 1. The device is operable also if short-circuiting is prevented by a layer of polymeric material on the workpiece. It should be noted, however, that the losses increase with the thickness of the said layer.

Upon application of a voltage, the coils generate a magnetic field which is conducted in the circuit formed by the core 1 and the workpiece 8 and also occurs outside the core. The magnetic field conducted in the core passes through the central metal portion of the workpiece 8 and heats it. The magnetic field outside the core will heat the peripheral metal portions of the workpiece by induction. By using a relatively low frequency in the range 16–400 Hz, adequate penetration depth in the metal is obtainable, and so the metal is uniformly heated.

Upon separation of polymeric material and metal, the heating of the metal causes a chemical degradation of the layer of the polymeric material in contact with the metal.

The frequency can be varied in dependence on the thickness of the workpiece If a penetration depth of about 2 cm is desired, the frequency is set at about 25 Hz. For heating thin-walled workpieces, the frequency may be for example 200 Hz.

In FIG. 1, the coils are connected in series, but can also be connected in parallel, provided that their magnetic fields cooperate to heat the workpiece.

At least the first coil 4 can be raised and lowered to control the heating of the workpiece. A microprocessor is preferably used for controlling the movement of the coil 4 and the movable pole 3. If desired, also the remaining coils can be made vertically movable. In some cases, the coil 6 may be omitted, and then the magnetic field generated by the coils 4 and 5 is sufficient to heat both the peripheral portions and the central portion of the workpiece. On the other hand, the coil 6 assists in concentrating the magnetic field outside the core to the workpiece peripheral portions.

Heating a workpiece to 450° C. in a conventional hot-air furnace would take 10 hours, but with the new technique according to the present invention the heating takes but a fraction of this time, for example 15 min. The new technique gives a temperature which differs by not more than ±5° C. throughout the cross-sectional area of the workpiece.

Figure 2:
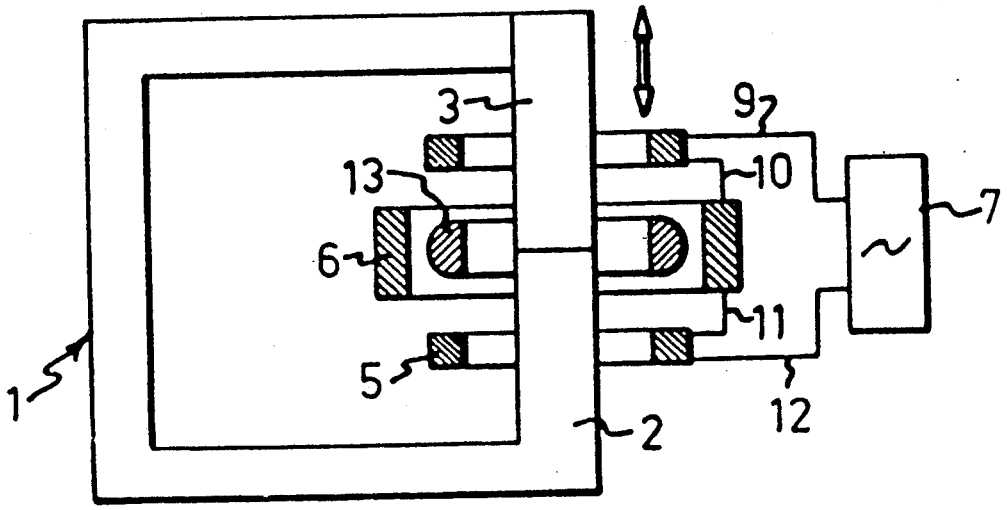
FIG. 2 shows a second embodiment in which the workpiece is a secondary winding of the circuit.

In FIG. 2, a workpiece in the form of a ring 13 is heated. In this embodiment, the movable pole 3 has been lowered to engage the stationary pole 2. Upon activation of the cores, an electrical current is produced in the workpiece 13 which assists in heating the workpiece. As in the embodiment according to FIG. 1, the magnetic field from the coils 4. 5 and 6 induces heat within the workpiece.

Figure 3:
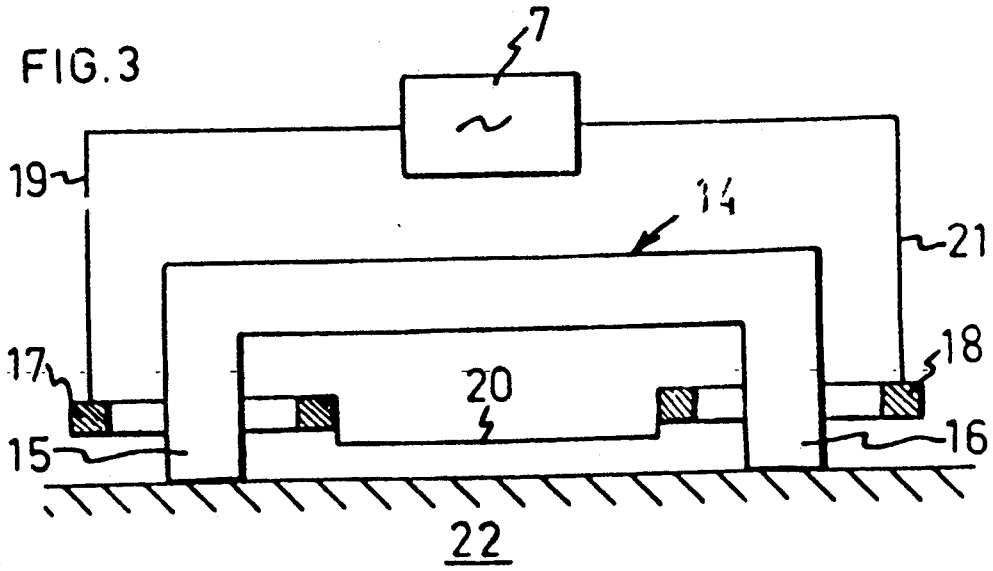

FIG. 3 shows a device for removing polymeric material from a large workpiece, such as a metal tank. The device comprises a U core 14, the legs of which are provided each with one coil 17 and 18, respectively. The coils are connected in series by means of lines 19, 20 and 21 and connected to a voltage source 7 of the type mentioned above. The device is applied to the tank 22, and the magnetic field generated upon activation of the coils is conducted through the U core 14 and the tank region between the legs 15 and 16 which is heated to the desired temperature by controlling the applied voltage, the frequency and the time during which voltage is applied When the region has been heated, the device is moved to another region of the tank and the polymeric material of the area first heated simply is peeled off.

In the embodiments described above, a short-circuited core has been used. In some cases, it is also possible to utilise only the poles 2 and 3 of the core and to dispense with the remaining core part, although a higher current consumption and higher losses are then obtained

I claim:

1. A device for heating a workpiece consisting at least partly of metal, said device comprising a coil arrangement positioned around a core of electric steel sheeting, and a voltage source connected to said coil arrangement for producing a magnetic field around said coil arrangement in said core and outside said core, said core having a first pole and a second pole forming between them an air gap for accommodating a central portion of a workpiece which is heated by said magnetic field which is concentrated in said core, said coil arrangement including a first coil positioned around said first pole, and a second coil connected to said first coil positioned around said second pole, said first and second coils being disposed opposite one another to form therebetween a space for accommodating peripheral portions of the workpiece, such that said first and second coils, by means of said magnetic field outside said core, contribute to heating the peripheral portions of the workpiece whereby rapid and uniform heating in the workpiece is achieved.

2. A device as claimed in claim 1 wherein at least said first coil is movable with respect to said first pole for controlling the degree of heating in the workpiece.

3. A device as claimed in claim 2 wherein said coil arrangement includes at third coil positioned between said first and said second coils and adapted to surround the workpiece to assist in heating the peripheral portions of the workpiece outside the air gap.

4. A device as claimed in claim 3 wherein said first, second and third coils are connected in series.

5. A device for heating an annular workpiece consisting at least partly of metal, comprising a first coil and a second coil which is connected to said first coil positioned in spaced apart relation around a core of electric steel sheeting and connected to a voltage source for generating a magnetic field around said coils in and outside said core, said core being separable for insertion of a workpiece between said coils, the workpiece forming a secondary winding having a turn in which an electric current is induced by said magnetic field concentrated in said core, and including a third coil connected to said voltage source and positioned between said first and said second coils and adapted to surround the workpiece, whereby said first, second and third coils define an annular heating cavity for accommodating the workpiece, said electric current in the secondary winding and said magnetic field outside said core in the heating cavity together heating the workpiece whereby rapid and uniform heating in the workpiece is achieved.

6. A device as claimed in claim 5 wherein said first, second and third coils are connected in series.

7. A device as claimed in claim 5 or claim 6 wherein at least said first coil is movable with respect to said core for controlling the degree of heating in the workpiece.

8. A device for heating a workpiece consisting at least partly of metal, said device comprising a coil arrangement positioned around a core of electric steel sheeting, and a voltage source connected to said coil arrangement for producing a magnetic field around said coil arrangement in said core and outside said core, said core having a first pole and a second pole forming between them at an air gap for accommodating a central portion of a workpiece which is heated by said magnetic field which is concentrated in said core, said coil arrangement including a first coil positioned around said first pole, and a second coil positioned around said second pole, said first and second coils being connected to each other and disposed opposite one another to form therebetween a space for accommodating peripheral portions of the workpiece, such that said first and second coils, by means of said magnetic field outside said core, contribute to heating the peripheral portions of the workpiece, and wherein said first pole is movable with respect to said second pole for engaging one of said second pole and the workpiece and for short circuiting said core whereby rapid and uniform heating in the workpiece is achieved.

* * * * *